US007070893B2

(12) United States Patent
Chambers et al.

(10) Patent No.: US 7,070,893 B2
(45) Date of Patent: Jul. 4, 2006

(54) THICK INTERMEDIATE AND UNDERCOATING LAYERS FOR ELECTROPHOTOGRAPHIC IMAGING MEMBERS, AND METHOD FOR MAKING THE SAME

(75) Inventors: John S. Chambers, Rochester, NY (US); Liang-Bih Lin, Webster, NY (US); Jin Wu, Webster, NY (US); Jennifer Y. Hwang, Penfield, NY (US); Linda L. Ferrarese, Rochester, NY (US); Francisco López, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 188 days.

(21) Appl. No.: 10/758,046

(22) Filed: Jan. 16, 2004

(65) Prior Publication Data

US 2005/0158640 A1 Jul. 21, 2005

(51) Int. Cl.
*G03G 5/14* (2006.01)

(52) U.S. Cl. ..... 430/60; 430/64; 430/57.2; 430/57.4; 430/57.8

(58) Field of Classification Search ..... 430/60, 430/57.2, 57.4, 57.8, 64
See application file for complete search history.

(56) References Cited

U.S. PATENT DOCUMENTS

| | | | | |
|---|---|---|---|---|
| 4,035,520 | A | | 7/1977 | Moriconi et al. |
| 4,618,248 | A | | 10/1986 | Buchar |
| 4,871,635 | A | | 10/1989 | Seki et al. |
| 5,122,429 | A | * | 6/1992 | Sundararajan et al. ..... 430/58.8 |
| 5,471,313 | A | | 11/1995 | Thieret et al. |
| 5,541,721 | A | | 7/1996 | Scheuer et al. |
| 5,635,324 | A | | 6/1997 | Rasmussen et al. |
| 5,863,686 | A | | 1/1999 | Yuh et al. |
| 5,922,498 | A | | 7/1999 | Yuh et al. |
| 5,923,834 | A | | 7/1999 | Thieret et al. |
| 6,063,533 | A | | 5/2000 | Yanus et al. |
| 2002/0045115 | A1 | | 4/2002 | Carmichael et al. |
| 2003/0013042 | A1 | | 1/2003 | Brabbs et al. |
| 2003/0113646 | A1 | | 6/2003 | Scharfe et al. |

* cited by examiner

*Primary Examiner*—Mark A. Chapman
(74) *Attorney, Agent, or Firm*—Oliff & Berridge PLC

(57) ABSTRACT

An electrographic or electrostatographic imaging member comprises a supporting substrate, an undercoating layer, a charge generating layer, and a charge transport layer. Thick undercoating layers were prepared with a charge erase enabler by doping an undercoating layer with a charge generating pigment that is strongly absorbing at typical erase lamp light. Doped thick undercoating layers demonstrate good electrical properties with an erase energy reduction of at least 50 V. A process for fabricating an imaging member and an apparatus comprising such an member are also disclosed.

14 Claims, 2 Drawing Sheets

THICK INTERMEDIATE AND UNDERCOATING LAYERS FOR ELECTROPHOTOGRAPHIC IMAGING MEMBERS, AND METHOD FOR MAKING THE SAME

BACKGROUND OF THE INVENTION

1. Field of Invention

This invention generally relates to imaging members for electrophotography.

2. Description of Related Art

In electrophotography, an electrophotographic substrate containing a photoconductive insulating layer on a conductive layer is imaged by first uniformly electrostatically charging a surface of the substrate. The substrate is then exposed to a pattern of activating electromagnetic radiation, such as, for example, light. The light or other electromagnetic radiation selectively dissipates the charge in illuminated areas of the photoconductive insulating layer while leaving behind an electrostatic latent image in non-illuminated areas of the photoconductive insulating layer. This electrostatic latent image is then developed to form a visible image by depositing finely divided electroscopic marking particles on the surface of the photoconductive insulating layer. The resulting visible image is then transferred from the electrophotographic substrate to a necessary member, such as, for example, an intermediate transfer member or a print substrate, such as paper. This image developing process can be repeated as many times as necessary with reusable photoconductive insulating layers.

Electrophotographic imaging members (i.e. photoreceptors) are well known. Electrophotographic imaging members are commonly used in electrophotographic (xerographic) processes having either a flexible belt or a rigid drum configuration. These electrophotographic imaging members sometimes comprise a photoconductive layer including a single layer or composite layers. These electrophotographic imaging members take many different forms. For example, layered photoresponsive imaging members are known in the art. U.S. Pat. No. 4,265,990 describes a layered photoreceptor having separate photogenerating and charge transport layers. The photogenerating layer disclosed in the 990 patent is capable of photogenerating holes and injecting the photogenerated holes into the charge transport layer. Thus, in the photoreceptors of the 990 patent, the photogenerating material generates electrons and holes when subjected to light.

More advanced photoconductive photoreceptors containing highly specialized component layers are also known. For example, a multilayered photoreceptor employed in electrophotographic imaging systems sometimes includes one or more of a substrate, an undercoating layer, an intermediate layer, an optional hole or charge blocking layer, a charge generating layer (including a photogenerating material in a binder) over an undercoating layer and/or a blocking layer, and a charge transport layer (including a charge transport material in a binder). Additional layers such as one or more overcoating layer or layers are also sometimes included.

U.S. Pat. No. 5,958,638 discloses some known materials used for undercoating layers. Materials known to be usable in intermediate and undercoating layers include a resin material alone, such as polyethylene, polypropylene, polystyrene, acrylic resin, vinyl chloride resin, vinyl acetate resin, polyurethane, epoxy resin, polyester, melamine resin, silicone resin, polyvinyl butyryl, polyamide and copolymers containing two or more of repeated units of these resins.

Such resin materials also include casein, gelatin, polyvinyl alcohol, ethyl cellulose, etc. Intermediate and undercoating layers are typically formed by a dip coating process, such as the methods disclosed in, for example, U.S. Pat. Nos. 5,958,638 and 5,891,594.

U.S. Pat. No. 5,471,313 discloses a xerographic device having a laser power controller that includes a setup routine. The setup routine disclosed in the 313 patent determines a relationship between an initial charge on a photoreceptor $V_{hi}$ and an exposed voltage, $V_{low}$, as a function of a laser power setting. The setup routine disclosed in the 313 patent stores these relationships as curves on a graph. These curves provide an initial estimate of the required laser power. A feedback laser power controller takes an initial charge level, $V_{hi}$, and a discharge ratio, DR, and determines an appropriate discharge level from the setup data. The controller measures the exposed voltage, $V_{low}$, on the photoreceptor and adjusts the laser power to convert for changing photoreceptor properties. The discharge ratio, DR, is equal to the ratio $(V_{low}-V_{res})/(V_{hi}-V_{res})$, where $V_{res}$ equals a baseline voltage, measured by exercising the laser power exposure until the exposed voltage does not discharge further with increasing exposure power. The discharge ratio indicates where a development potential, $V_{dev}$, and a cleaning potential, $V_{clean}$, are positioned on a photo-induced discharge curve, where $V_{clean}$ is a cleaning potential equal to the difference between a housing bias voltage and the voltage of areas discharged by exposure. The expression "photo-induced discharge curve" (PIDC), as used here, refers to a relationship between the potential as a function of exposure and a measure of the sensitivity of the device. The photo-induced discharge curve generally represents the supply efficiency i.e., the number carriers injected from the generator layer into the transport layer per incident photon, as a function of the field across the device.

U.S. Pat. No. 5,797,064 discloses a pseudo photo-induced discharge curve setup procedure for a xerographic system. The procedure disclosed in the 064 patent does not use an electrostatic voltmeter (ESV). Rather, the procedure for the 064 patent determines the location of a knee of the pseudo photo-induced discharge curve, in response to charging a photoreceptor or raster output scanner (ROS).

SUMMARY OF THE INVENTION

Such known photoconductors are susceptible to carrier injection from the substrate into the photosensitive layer such that the charge on the surface of the photoconductor may be microscopically dissipated or decayed. This often results in production of a defective image. Various exemplary embodiments of a photoreceptor according to this invention interpose an intermediate and undercoating layer between a substrate and a photosensitive layer to improve chargeability of the photoconductor, and to enhance adhering and coating properties of the photosensitive layer with respect to the substrate.

The above-mentioned treatment techniques are deficient in several ways. Defects in subsystems of a xerographic, electrophotographic or similar image forming system, such as a laser printer, digital copier or the like, may give rise to visible streaks or defects in a printed image. Such defects often arise from a non-uniform LED imager, contamination of high voltage elements in a charger, scratches in the photoreceptor surface, or other causes. For example, the intermediate and undercoating layer used in certain conventional devices is derived from needle-shaped titanium dioxide nanoparticles dispersed in thermally cross-linkable phenolic resin. This sometimes results in one or more of the previously mentioned defects.

This invention provides a thick intermediate and/or undercoating layer for photoreceptors.

This invention separably provides a thick intermediate and/or undercoating layer including a charge erase enhancer.

This invention separably provides a photoconductive imaging member having a substrate, a thick intermediate and/or undercoating layer including a polymer resin and a charge erase enhancer, and a photosensitive component.

This invention separably provides an electrophotographic or electrostatographic apparatus including a photoconductive imaging member.

This invention separably provides a method for making a thick intermediate and/or undercoating layer.

This invention separably provides a method for making a thick intermediate and/or undercoating layer having a charge erase enhancer.

These and other features and advantages of various exemplary embodiments of materials, devices, systems and/or methods according to this invention are described in, or are apparent from, the following detailed description of the various exemplary embodiments of the systems and methods according to this invention.

DETAILED DESCRIPTION OF EXEMPLARY EMBODIMENTS

Figure 1:
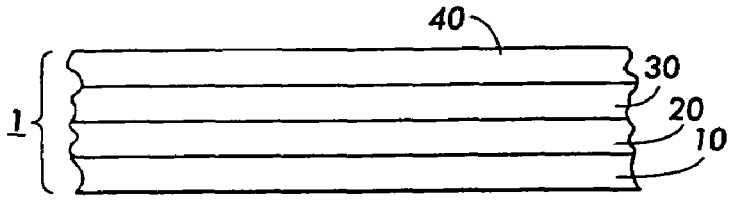
FIG. 1 shows an exemplary schematic of an electrophotographic imaging member according to the invention.

In various exemplary embodiments of an electrophotographic imaging member in accordance with this invention, an imaging member includes a substrate; at least one of an intermediate and/or undercoating layer formed on the substrate; at least one optional additional layer that may be located on or under the at least one of an intermediate and/or undercoating layer and a photoconductor or photosensitive layer formed on the at least one of an intermediate and/or undercoating layer. In various exemplary embodiments, a photoconductor layer includes a photogenerating layer and a charge transport layer. Various exemplary embodiments include other layers, such as an adhesive layer.

In various exemplary embodiments of this invention, an intermediate and/or undercoating layer is located between a substrate and a photoconductor photosensitive layer. In various exemplary embodiments, additional layers are present and are located between a substrate layer and a photoconductive or photosensitive layer.

In various exemplary embodiments of the invention, an intermediate and/or undercoating layer includes at least one material selected from resin material alone, such as polyethylene, polypropylene, polystyrene, acrylic resin, vinyl chloride resin, vinyl acetate resin, polyurethane, epoxy resin, polyester, melamine resin, silicone resin, polyvinyl butyryl, polyamide and copolymers containing two or more of repeated units of these resins. Such resin materials also include casein, gelatin, polyvinyl alcohol, ethyl cellulose, etc. Intermediate and/or undercoating layers are typically formed by a dip coating process, such as the methods disclosed in, for example, U.S. Pat. Nos. 5,958,638 and 5,891,594.

Conventional intermediate and undercoating layers are believed by some to be limited to a thickness of about 5 μm. Beyond this thickness limitation, the exposed voltage, $V_{low}$, and cyclic stability properties deteriorate with the conventional art and make photoreceptors unsuitable for modern xerographic engines.

Various exemplary embodiments of the invention include an intermediate and/or undercoating layer having a thickness greater than 5 μm. In various exemplary embodiments, the intermediate and/or undercoating layer has a thickness from about 5 μm to about 20 μm or more. Thus, for example, in embodiments of the present invention, the thickness of the intermediate and/or undercoating layer is from greater than 5 μm (such as from about 6 or about 7 μm) to about 30 or about 40 μm, and, in some embodiments, from about 7.5 or from about 20. However, thicknesses outside these ranges can be used, as desired.

In various exemplary embodiments of this invention, a discharge ratio, DR, is equal to a ratio $(V_{low}-V_{res})/(V_{hi}-V_{res})$, where $V_{res}$ equals a baseline voltage, measured by exercising laser power exposure until the exposed voltage does not discharge further with increasing exposure power, as discussed above. The discharge ratio indicates how the development potential, $V_{dev}$, and potential used to erase the image from the imaging member, $V_{erase}$ are positioned on the photo-induced discharge curve, where $V_{erase}$ is an erasing potential, equal to the difference between a housing bias voltage and the voltage of areas discharged by exposure.

Various exemplary embodiments of this invention include at least one intermediate and/or undercoating layer including at least one charge erase enhancer as an additive. In various exemplary embodiments, by doping a thick intermediate and/or undercoating layer with a charge erase enhancer, residual charges in the intermediate and undercoating layer and at an interface of the intermediate and/or undercoating layer and the charge generating layer are reduced, enabling the imaging member to be erased by a lower voltage field than would otherwise be necessary. In various exemplary embodiments, a charge erase enhancer is dispersed throughout the intermediate and/or undercoating layer.

Any suitable charge erase enhancer may be included in the intermediate and/or undercoating layer of various exemplary embodiments. According to the present invention, such charge erase enhancers include, but are not limited to, those materials that are conventionally known and used as organic or inorganic photoconductive particles in imaging member photogenerating layers. Such materials are disclosed in, for example, U.S. Pat. No. 6,165,660. A difference, however, is that the charge erase enhancer is doped into the intermediate and/or undercoating layer, in addition to its use (or use of other materials) as photoconductive particles in a charge generating layer. Examples of typical photoconductive particles, and thus of useful charge erase enhancers, include, but are not limited to, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from Dupont under the trade name Monastral Red, Monastral violet and Monastral Red Y, Vat orange 1 and Vat orange 3 trade names for dibromoanthanthrone pigments, benzimidazole perylene, perylene pigments as disclosed in U.S. Pat. No. 5,891,594, the entire disclosure of which is incorporated herein by reference, substituted 2,4-diamino-triazines disclosed in U.S. Pat. No. 3,442,781, polynuclear aromatic quinones available from Allied Chemical Corporation under the trade name Indofast Double Scarlet, Indofast Violet Lake B, Indofast Brilliant Scarlet and Indofast Orange, and the like. In various exemplary embodiments, the charge erase enhancer is dibromoanthanthrone, although other currently known or later developed materials can be used. In various exemplary embodiments of this invention, a thick intermediate and/or undercoating layer includes dibromoanthanthrone as a charge erase enhancer, and the intermediate and/or undercoating layer has a functional thickness of 20 μm or more.

Residual charges in an intermediate and/or undercoating layer, as well as those residing at an interface between the intermediate and/or undercoating layer and a charge generating layer, can be reduced in various exemplary embodiments of the invention, by doping a charge generating materials with a strong absorption at 600–700 nm, where the wavelength of a typical erase lamp lies. Thus, thicker intermediate and/or undercoating layers become feasible. Accordingly, in various exemplary embodiments of the present invention, the charge erase enhancer has a strong absorption in a light wavelength range that matches an erase lamp used in the imaging process, such as in the common wavelength range of about 600–700 nm.

Figure 2:
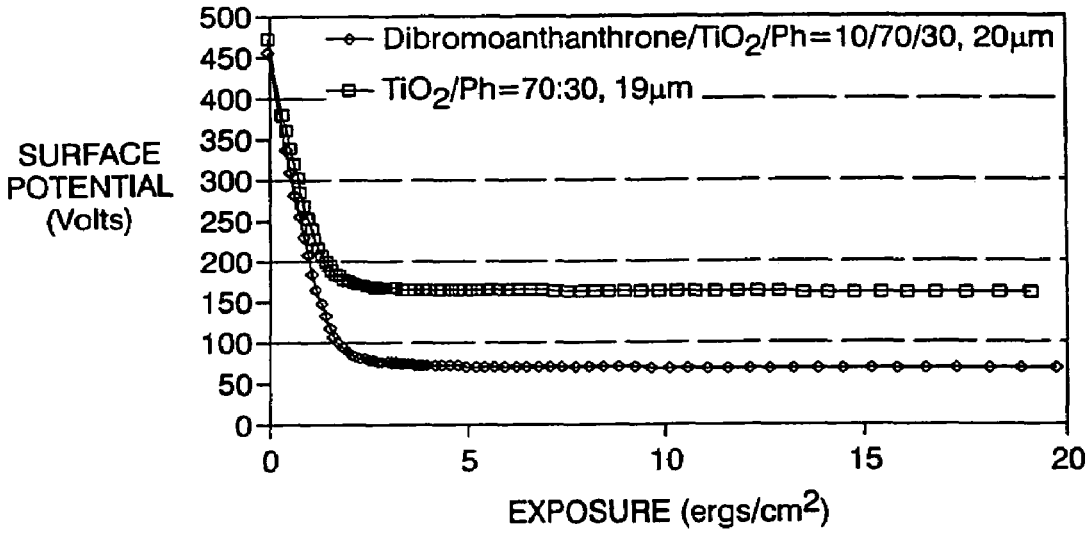
FIG. 2 shows exemplary PIDC curves obtained from thick undercoating layer devices both with and without dibromoanthanthrone doping. The $V_{low}$ difference is greater than 50 V.

In various exemplary embodiments, advantages of charge erase enhancer doped devices are more pronounced when the thickness of an intermediate and/or undercoating layer increases. For example, when dibromoanthanthrone is used as a charge erase enhancer, $V_{erase}$ is reduced by at least 50 V, relative to a 16 μm control layer. Stable charging, $V_{low}$ and $V_{erase}$ are observed in cyclic testing for 7.5 and 20 μm dibromoanthanthrone-doped undercoating layer (FIG. 2).

In various exemplary embodiments of this invention, photoreceptors incorporating at least one thick intermediate and/or undercoating layer doped with at least one charge erase enhancer show excellent electrical properties with low dark decay, low voltage residue, and high photosensitivity.

The structure of a photoconductive member according to various exemplary embodiments of the invention can follow any of various known photoreceptor designs, modified to include above-described various exemplary embodiments of intermediate and/or undercoating layers of the invention. Because photoreceptor designs are well known in the art, the remaining layers of the photoreceptor will be described only in brief detail for completeness.

In various exemplary embodiments, and as generally shown in FIG. 1, the imaging member 1 comprises a supporting substrate 10, an intermediate and/or undercoating layer 20, and a photogenerating layer and a charge transport layer (which can be separate or combined into a single photoconductor layer 30 as shown in FIG. 1).

In various exemplary embodiments of this invention, an overcoat layer 40 is added to improve resistance to abrasion. In various exemplary embodiments of this invention, a back coating is applied to the side opposite the imaging side of the photoreceptor to provide flatness and/or abrasion resistance. These overcoat and back coat layers can include any suitable composition, such as, for example, organic polymers or inorganic polymers that are electrically insulating or slightly semi-conductive.

In various exemplary embodiments, a photoconductive imaging member includes a supporting substrate, an intermediate and/or undercoating layer, an adhesive layer, a photogenerating layer and a charge transport layer. These and other exemplary photoreceptor designs, which can be applied in embodiments of the present invention, are described in, for example, U.S. Pat. Nos. 6,165,660, 3,357,989, 5,891,594, and 3,442,781, the entire disclosures of which are incorporated herein by reference.

In various exemplary embodiments, the supporting substrate includes a conductive metal substrate. In various exemplary embodiments, a conductive substrate is, for example, at least one member selected from the group consisting of aluminum, aluminized or titanized polyethylene terephthalate belt (MYLAR®).

In various exemplary embodiments, the photogenerator layer has any suitable thickness. In various exemplary embodiments, the photogenerator layer has a thickness of from about 0.05 to about 10 μm. In various exemplary embodiments, the transport layer has a thickness of from about 10 to about 50 μm. In various exemplary embodiments, the photogenerator layer includes photogenerating pigments dispersed in a resinous binder in an amount of from about 5 percent by weight to about 95 percent by weight. In various exemplary embodiments, the resinous binder is any suitable binder. In various exemplary embodiments, the resinous binder is at least one member selected from the group consisting of polyesters, polyvinyl butyrals, polycarbonates, polystyrene-b-polyvinyl pyridine, and polyvinyl formals.

In various exemplary embodiments, a charge transport layer can include aryl amine molecules. In various exemplary embodiments, a charge transport layer can include aryl amines of the following formula:

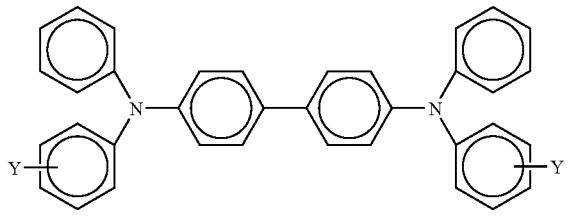

wherein Y selected from the group consisting of alkyl and halogen, and wherein the aryl amine is dispersed in a highly insulating and transparent resinous binder. In various exemplary embodiments, the arylamine alkyl contains from about 1 to about 10 carbon atoms. In various exemplary embodiments, the arylamine alkyl contains from 1 to about 5 carbon atoms. In various exemplary embodiments, the arylamine alkyl is methyl, the halogen is chlorine, and the resinous binder is selected from the group consisting of polycarbonates and polystyrenes. In various exemplary embodiments, the aryl amine is N,N'-diphenyl-N,N-bis(3-methyl phenyl)-1,1'-biphenyl-4,4'-diamine.

In various exemplary embodiments, a photoconductive imaging member includes an adhesive layer of a polyester with an $M_w$ of about 70,000, and an $M_n$ of from about 25,000 to about 50,000. In various exemplary embodiments, a photoconductive imaging member includes an adhesive layer of a polyester with an $M_n$ of about 35,000.

In various exemplary embodiments, a photogenerating layer includes metal phthalocyanines and/or metal free phthalocyanines. In various exemplary embodiments, a photogenerating layer includes at least one phthalocyanine selected from the group consisting of titanyl phthalocyanines, perylenes, or hydroxygallium phthalocyanines. In various exemplary embodiments, a photogenerating layer includes Type V hydroxygallium phthalocyanine.

Various exemplary embodiments of the invention include a method of imaging which includes generating an electrostatic latent image on an imaging member, developing a latent image, and transferring the developed electrostatic image to a suitable substrate.

Various exemplary embodiments of this invention include methods of imaging and printing with the photoresponsive devices illustrated herein. Various exemplary embodiments include methods including forming an electrostatic latent image on an imaging member; developing the image with a toner composition including, for example, at least one thermoplastic resin, at least one colorant, such as pigment, at least one charge additive, and at least one surface additive; transferring the image to a necessary member, such as, for example any suitable substrate, such as, for example, paper; and permanently affixing the image thereto. In various exemplary embodiments in which the embodiment is used in a printing mode, various exemplary imaging methods include forming an electrostatic latent image on an imaging member by use of a laser device or image bar; developing the image with a toner composition including, for example, at least one thermoplastic resin, at least one colorant, such as pigment, at least one charge additive, and at least one surface additive; transferring the image to a necessary member, such as, for example any suitable substrate, such as, for example, paper; and permanently affixing the image thereto.

EXAMPLE

The following Example is submitted to illustrate an embodiment of the invention. This Example is intended to be illustrative only and is not intended to limit the scope of the invention.

Dibromoanthanthrone is doped in a dispersion of titanium dioxide and phenolic resin, and undercoating layers are prepared.

Samples are prepared by milling dibromoanthanthrone together with titanium dioxide and phenolic resin in a mixture of xylene and butanol; the milling end point is determined by particle size analysis. Several 30 mm size devices are prepared with undercoating layer thicknesses varying from 4 to 20 μm. Control devices are also prepared, without dibromoanthanthrone-doping in the undercoating layer.

FIG. 2 shows PIDCs of two devices with either dibromoanthanthrone doping or regular titanium dioxide/phenolic resin undercoating layers at about 20 μm in thickness. The curves clearly show improved electrical properties for layers doped with dibromoanthanthrone at thicknesses of about 20 μm.

Figure 3:
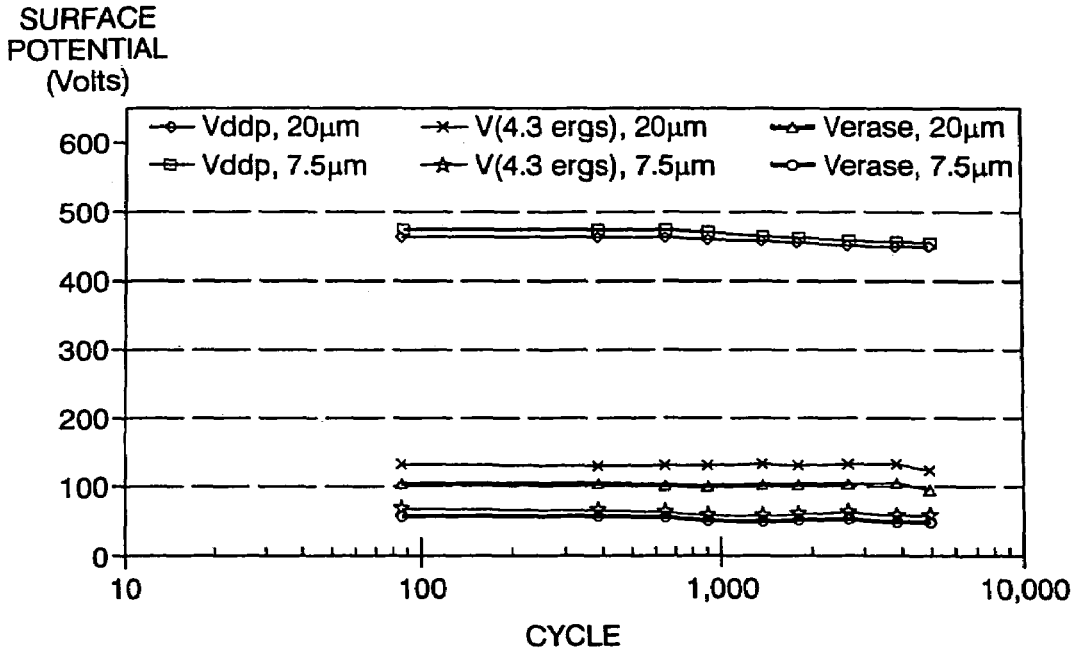
FIG. 3 shows exemplary cyclic data for two representative dibromoanthanthrone-doped undercoating layer devices of 7.5 and 20 μm undercoating layer thickness.

FIG. 3 shows cyclic data for exemplary undercoating layers according to the inventions. Specification, FIG. 5 shows that charging, $V_{low}$ and $V_{erase}$, for undercoating layers doped with dibromoanthanthrone at thicknesses of 7.5 to 20 μm, remains stable. $V_{erase}$ becomes less than 100 V for an undercoating layer of 20 μm; in contrast, the value would be over 180 V for the regular titanium dioxide-based undercoating layer.

Representative electrical data is listed in Table 1.

TABLE 1

| Device | DV/dX | V (4.3 ergs/cm$^2$) | $V_{erase}$ |
|---|---|---|---|
| $TiO_2$/Phenolic resin (7 μm) | 263 | 51 | 40 |
| $TiO_2$/Phenolic resin/ dibromoanthanthrone (7.5 μm) | 279 | 58 | 50 |
| $TiO_2$/Phenolic resin (16 μm) | 280 | 173 | 150 |
| $TiO_2$/Phenolic resin/ dibromoanthanthrone (20 μm) | 286 | 130 | 103 |

As is apparent from the results in Table 1, doping the intermediate and undercoating layer with a charge erase enhancer such as dibromoanthanthrone provides a significant improvement of the charging and erasing properties of the intermediate and undercoating layer.

While this invention has been described in conjunction with the exemplary embodiments outlined above, various alternatives, modifications, variations, improvements, and/or substantial equivalents, whether known or that are, or may be, presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the systems, methods and devices according to this invention are intended to embrace all known or later-developed alternatives, modifications, variations, improvements, and/or substantial equivalents.

What is claimed is:

1. An electrophotographic imaging member, comprising:

a substrate;

an undercoating layer; and a photoconductor layer;

wherein the undercoating layer comprises a polymer resin and a charge erase enhancer and the undercoating layer is more than about 5 μm in thickness; and wherein the photoconductor layer comprises a charge generating layer and a charge transport layer.

2. The electrophotographic imaging member according to claim 1, wherein the undercoating layer is from about 7.5 μm to 20 μm in thickness.

3. The electrophotographic imaging member according to claim 1, wherein the undercoating layer is more than about 20 μm in thickness.

4. The electrophotographic imaging member according to claim 1, wherein the charge erase enhancer comprises an organic or inorganic photoconductive particle.

5. The electrophotographic imaging member according to claim 1, wherein the charge erase enhancer is dispersed in the polymer resin.

6. The electrophotographic imaging member according to claim 1, wherein the charge erase enhancer is at least one member chosen from the group consisting of inorganic photoconductive particles and organic photoconductive particles.

7. The electrophotographic imaging member according to claim 6, wherein the inorganic photoconductive particles are dibromoanthanthrone.

8. The electrophotographic imaging member according to claim 1, wherein the polymer resin is chosen from the group consisting of thermally cross-linkable polymer resins.

9. The electrophotographic imaging member according to claim 1, wherein the polymer resin comprises at least one resin selected from the group consisting of polyethylenes, polypropylenes, polystyrenes, acrylic resins, vinyl chloride resins, vinyl acetate resins, polyurethanes, epoxy resins, polyesters, melamine resins, silicone resins, polyvinyl butyryls, polyamides, phenolic resins and copolymers and mixtures thereof.

10. The electrophotographic imaging member according to claim 1, wherein the polymer resin further comprises at least one additional material selected from the group consisting of caseins, gelatins, polyvinyl alcohols and ethyl celluloses and mixtures thereof.

11. The electrophotographic imaging member according to claim 1, wherein the undercoating layer further comprises titanium dioxide particles.

12. The electrophotographic imaging member according claim 1, wherein the titanium dioxide particles are nanoparticles.

13. The electrophotographic imaging member according to claim 1, wherein at least one of the electrostatic potentials, initial changing potential, exposed voltage and exposed voltage at saturation is stable under cyclic testing.

14. An apparatus comprising the electrophotographic imaging member according to claim 1.

* * * * *